United States Patent [19]

Takahashi et al.

[11] 4,436,561

[45] Mar. 13, 1984

[54] PRESS-FORMABLE HIGH STRENGTH DUAL PHASE STRUCTURE COLD ROLLED STEEL SHEET AND PROCESS FOR PRODUCING THE SAME

[75] Inventors: Nobuyuki Takahashi; Yoshikuni Furuno, both of Kitakyushu; Masaaki Fukunaga, Onga, all of Japan

[73] Assignee: Nippon Steel Corporation, Japan

[21] Appl. No.: 281,206

[22] Filed: Jul. 6, 1981

[30] Foreign Application Priority Data

Jul. 5, 1980 [JP] Japan ..... 55-91998

[51] Int. Cl.[3] ..... C21D 8/04

[52] U.S. Cl. ..... 148/12 F; 148/12.4; 148/36

[58] Field of Search ..... 75/123 B; 148/12 C, 148/12 F, 36, 12.4

[56] References Cited

U.S. PATENT DOCUMENTS

| | | | |
|---|---|---|---|
| 3,951,696 | 4/1976 | Gondo et al. | 148/12 F |
| 4,001,052 | 1/1977 | Nakazato et al. | 75/123 B |
| 4,025,368 | 5/1977 | Sanbongi et al. | 148/36 |
| 4,115,155 | 9/1978 | Roe | 148/12 F |

FOREIGN PATENT DOCUMENTS

| | | | |
|---|---|---|---|
| 55-44551 | 3/1980 | Japan | 148/12 F |
| 55-104429 | 8/1980 | Japan | 148/12 C |
| 56-23230 | 3/1981 | Japan | 148/12.4 |

*Primary Examiner*—Peter K. Skiff

*Attorney, Agent, or Firm*—Wenderoth, Lind & Ponack

[57] ABSTRACT

A press-formable, high-strength, dual phase structure cold rolled steel sheet is disclosed. The sheet is made from steel consisting of C: 0.02–0.20%, Si: less than 0.1%, Mn: 1.0–2.0%, acid-soluble Al: 0.005–0.100%, B: more than 0.0003% and less than 0.0050% in terms of $B-0.7\times N$ on the condition that B/C is more than 0.03, N: less than 0.0060%, the balance being iron and incidental impurities. A process for producing such steel sheet is also disclosed.

5 Claims, 1 Drawing Figure

PRESS-FORMABLE HIGH STRENGTH DUAL PHASE STRUCTURE COLD ROLLED STEEL SHEET AND PROCESS FOR PRODUCING THE SAME

FIELD OF THE INVENTION

This invention relates to an easily press-formable, high strength, dual phase structure (ferrite+martensite) cold rolled steel sheet having a tensile strength on the order of 40 to 50 kg/mm$^2$ and a low yield point. The invention also relates to a process for producing such steel sheet.

BACKGROUND OF THE INVENTION

To provide safety for occupants and decrease gas mileage, the demand for high-strength cold rolled steel sheet for use in automobile parts has increased rapidly in recent years. With the current press-forming technique, most of the inside and outside panels of automobiles are made of cold rolled sheets having a tensile strength of from 35 to 50 kg/mm$^2$ and it is considered very difficult to apply cold rolled sheets having a tensile strength of 60 kg/mm$^2$ or more to these parts.

High-strength cold rolled steel sheets given high strength by solid solution or precipitation have been developed for use in inside sheets and outside skins, but their high strength is unavoidably accompanied by increased yield point which not only makes press-forming difficult but also increases the tendency of spring-back to which results in low ability to retain the form obtained by pressing. To solve this problem, a high-strength, dual phase structure cold rolled steel sheet having the ferrite phase and martensite phase has been proposed. An annealed product of this steel sheet does not develop yield point-elongation, has low yield ratio and exhibits good ductility, and hence meets the present need of the car manufacturing industry. A high strength range product having a tensile strength of more than 50 kg/mm$^2$ is fairly easy to make from this dual phase structure steel sheet, but it is not easy to produce a low strength range dual phase structure cold rolled steel sheet of the type contemplated by this invention, i.e. a steel sheet having a tensile strength of the order of 40 to 50 kg/mm$^2$ and a low yield ratio.

SUMMARY OF THE INVENTION

We have therefore made studies to develop a dual phase structure, high-strength, cold rolled steel sheet of low yield ratio that has a tensile strength on the order of 40 to 50 kg/mm$^2$ and whose yield point is as low as that of the common soft cold rolled steel sheet in the order of 20 to 30 kg/mm$^2$. As a result, we have successfully produced a new high-strength cold rolled steel sheet of a two-phase structure (ferrite phase and martensite phase) made of a low-alloy system comprising C, Mn, B and trace Si and which is free from the defects of the conventional product.

The steel sheet of this invention has the following composition:

C: 0.02–0.20%, Si: less than 0.1%, Mn: 1.0–2.0%, acid-soluble Al (hereunder referred to as sol.Al): 0.005–0.100%, B: more than 0.0003% and less than 0.0050% in terms of B−0.7 N on the condition that B/C is more than 0.03, N: less than 0.0060%, the balance being iron and incidental impurities.

The process for producing such steel sheet according to this invention is characterized by the following:

1. A process for producing a press-formable, high-strength, dual phase structure, cold rolled steel sheet which comprises hot rolling a steel slab of the above indicated composition at a finishing temperature higher than the $Ar_3$ transformation point, cooling the hot strip at a rate of 10 to 150° C./sec, coiling the strip at a temperature lower than 730° C., pickling and cold rolling the strip, soaking the strip at an annealing temperature in the range of from the $Ac_1$ transformation point to 800° C., and cooling the strip at a rate higher than 3° C./sec.

2. A process as defined above wherein the soaking time is in the range of from 20 seconds to 5 minutes.

3. A process as defined in par. 1 above wherein the soaking temperature and time are between 730° and 780° C. and between 60 seconds and 120 seconds, respectively.

4. A process as defined in par. 1 above wherein the cooling rate is between 10° and 50° C./sec.

DETAILED DESCRIPTION OF THE INVENTION

Figure 1:
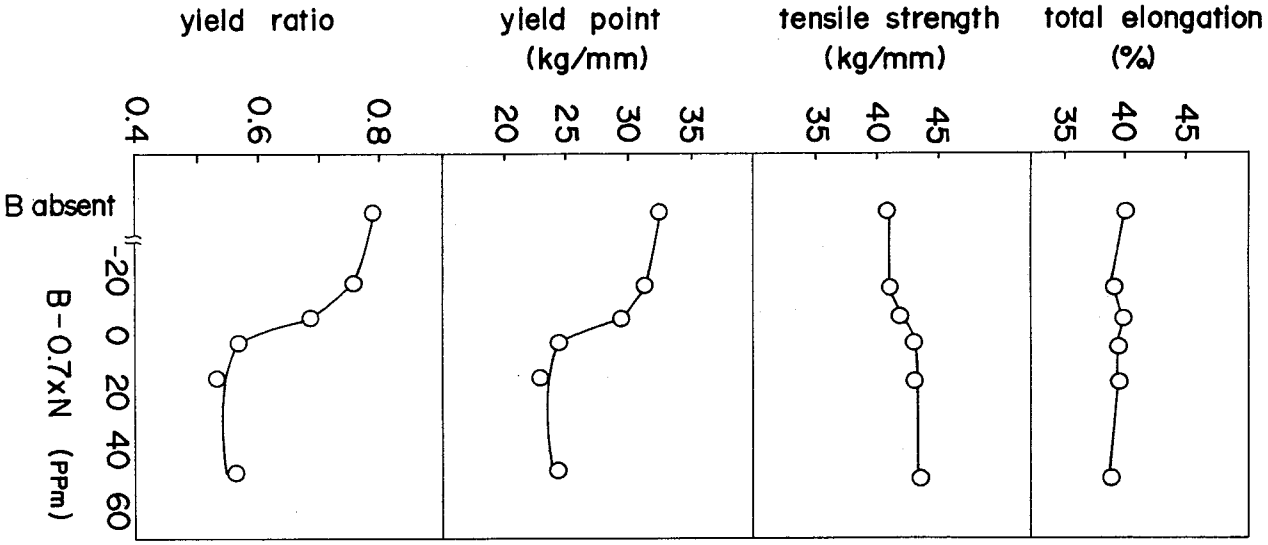
FIG. 1 is a graph showing the relation between B−0.7×N and the mechanical properties of steel sheets.

Conventional methods for producing a high-strength, complex structure cold rolled steel sheet having B incorporated therein are disclosed in Japanese Patent Publication No. 21811/79 and U.S. Pat. No. 3,951,696. The former reference discloses a high-strength cold rolled steel sheet having a tensile strength of about 50 to 90 kg/mm$^2$ and high stretchability. As shown in the Examples, the steel sheet has a higher yield point than 39 kg/mm$^2$. The sheet is intended for use as a bumper reinforcing material or a reinforcing beam for the interior of doors. To absorb maximum energy of collision, the sheet has high tensile strength and yield point. The latter reference discloses a press-formable cold rolled steel sheet having a tensile strength of 45 to 90 kg/mm$^2$ and a yield point of 35to 75 kg/mm$^2$. To produce a desired product, the carbon concentration of a steel strip under annealing at a temperature between the $A_1$ and $A_3$ transformation points is increased so that a high-strength hardened phase or complex structure is formed after cooling. The process described in this reference uses the ability of Si to increase the carbon concentration, so the resulting product contains up to 0.7% of Si. The product described in the first reference also has a high Si content to achieve high tensile strength and yield point.

The object of this invention is to provide a high-strength cold rolled steel sheet having a lower tensile strength and a much lower yield point than those of the prior art products described in the above two references. To meet this object, this invention reduces the Si content as much as possible, and by specifying the B and C contents and controlling the relation of B and N, the production of bainite, troostite, sorbite and other carbides that increase the yield point is prevented to the greatest extent possible, to thereby provide a steel sheet substantially consisting of the martensite phase and ferrite phase. Therefore, this invention is characterized by controlling the composition of a steel strip and the conditions for hot rolling it to provide a press-formable, high strength, dual phase structure, cold rolled steel sheet.

The criticality of the limitations on the contents of the respective components of the steel according to this invention is described below:

Carbon must be present in an amount greater than 0.02% to obtain the martensite phase by cooling from the two-phases ($\alpha+\gamma$) temperature range. A steel containing an excessive carbon content provides a steel sheet which has low formability and whose weldability is significantly bad. Therefore, the upper limit for the carbon content is 0.20%. Preferably, the carbon content is between 0.03 and 0.10%.

Generally, silicon expels carbon to the grain boundaries and facilitates the formation of a dual phase structure. But if Si is added to the steel contemplated by this invention, boron concentrated in the grain boundaries reacts with the expelled carbon during cooling subsequent to annealing in the ($\alpha+\gamma$) phase temperature range, and as a result, the amount of boron in solid solution that is the most important for the purpose of this invention is reduced, making the formation of the desired dual phase structure difficult. In consequence, the resulting product has high yield point, hence high yield ratio. Furthermore, silicon is one of the elements having a great ability to strengthen steels, and its addition in a small portion achieves increased strength. Therefore, silicon is unnecessary for obtaining the steel strength contemplated by this invention.

Manganese is an element that provides a stable gamma phase and facilitates the formation of a transformed structure upon cooling, and at least 1.0% of Mn is necessary for achieving the purpose of this invention. But if its content is too great, the steelmaking operation is difficult and the resulting product has low weldability. Therefore, the upper limit for the Mn content is 2.0%. Preferably, the Mn content is between 1.2 and 1.6%.

Aluminum is a deoxidizing element necessary for letting boron exhibit its effect (to be described below) fully. At least 0.005% of aluminum is necessary in the form of Sol.Al. If its content is too large, alumina clusters are formed that deteriorate the surface condition of the resulting steel sheet, and its formability is low. Therefore, the upper limit for the Al content is 0.100%.

Boron is also an important element for the purpose of this invention. Boron may be present in steels in the form of nitride, carbide, oxide and a solid solution. To achieve the object of this invention, i.e. a low yield ratio, dual phase structure, high strength cold rolled steel sheet, boron must be present in the form of a solid solution. But boron reacts easily with nitrogen in a gamma phase temperature range and the formation of boron nitride (BN) is unavoidable. Therefore, the content of boron in solid solution is represented by $B-0.7\times N$, i.e. the total B content minus the proportion that reacts with N, and for achieving the purpose of this invention, 0.0003% of boron is necessary in terms of $B-0.7\times N$. If the B content is too great, cracks may develop in the surface of the slab. Therefore, the upper limit for the B content in terms of $B-0.7\times N$ is 0.0050%.

FIG. 1 shows the relation between $B-0.7\times N$ and the mechanical properties of cold rolled steel sheets prepared by a process in laboratory which comprised hot rolling steel strip consisting of 0.05 to 0.06% of C, 0.01 to 0.02% of Si, 1.5 to 1.6% of Mn, 0.02 to 0.04% of sol. Al, 0.0040 to 0.0045% of N and O to 0.0080% of B, cold rolling the strips, soaking them at 775° C. for 2 minutes and annealing the strips continuously at a cooling rate of 20° C./sec. When the $B-0.7\times N$ corresponding to the content of B in solid solution exceeds 0.0003%, steel sheets having significantly low yield point result. It is therefore understood that not the absolute value of B content but the B content in solid solution is important for producing a high-strength cold rolled steel sheet which has low yield point and high formability.

To ensure the formation of boron in solid solution, the formation of boron oxides must be prevented by deoxidizing molten steel adequately with aluminum prior to addition of boron. It is very difficult to eliminate the formation of boron carbide completely. According to our study, to ensure a certain amount of boron in solid solution in the presence of a fairly large amount of carbon and to produce a dual phase structure, high-strength steel sheet of low yield ratio, the ratio of B to C (B/C) must be at least 0.03 and more in weight percent.

Nitrogen reacts with boron to form boron nitride and is detrimental to the formation of boron in solid solution. Therefore, the upper limit of the N content is 0.0060%, preferably 0.0040%.

Among incidental impurities are sulfur and phosphorus. Sulfur is deterimental to the production of an easily press-formable steel sheet, and hence its content is preferably less than 0.015%. Phosphorus is an element effective in forming a strong solid solution, so for the purpose of achieving a high-strength steel sheet, not more than 0.08% of P may be incorporated, but for the purpose of providing an easily press-formable steel sheet, the P content is preferably held to minimum.

In addition to the elements mentioned above, Cr, Mo and other elements that facilitate the formation of martensite are incorporated effectively in an amount of 0.2 to 1.0%. These elements may be used either alone or in combination. It is also effective for the purpose of providing high stretchability to add Ca, rare earth metals, Zr, and other elements that control the form of sulphides.

The criticality of the requirements specified for the process of this invention is described below. Molten steel having the composition defined above and prepared in an electric furnace, converter, etc. is subjected to ingot-making and slabing procedures or continuous casting to form a slab. The slab is then hot rolled at a finishing temperature higher than the $Ar_3$ transformation point, cooled at a rate of 10° to 150° C./sec, and coiled at a temperature lower than 730° C. If the finishing temperature is less than the $Ar_3$ transformation point, the desired dual phase structure is difficult to obtain. If the rate of cooling after hot rolling is too slow, a large amount of boron carbide is formed and a dual phase structure, cold rolled sheet having low yield ratio and high strength is not obtained. Therefore, the lower limit for the cooling rate is 10° C./sec. If the cooling rate is too fast, the hot rolled sheet has a bainitic quenched structure and acicular ferrite structure, and these structures cause high yield point of the cold rolled sheet and its significantly poor ductility. Therefore, the upper limit for the cooling rate is 150° C./sec. If the coiling temperature is higher than 730° C., a large amount of boron carbide is produced and the object of this invention is not achieved.

The hot rolled coil is then pickled, cold rolled, soaked at an annealing temperature between the $Ac_1$ transformation point and 800° C., and then cooled at a cooling rate faster than 3° C./sec. If the annealing temperature is lower than the $Ac_1$ transformation temperature, a two-phase structure consisting of the ferrite and martensite phases is not obtained. Therefore, the lower limit for the annealing temperature is the $Ac_1$ transformation point. If the annealing temperature exceeds 800° C., the volume ratio of the ferrite phase is decreased, and the resulting structure, though having the two phases, does not have the desired low yield ratio. If the soaking time is less than 20 seconds, the desired two-phase structure is not produced, and if the period exceeds 5 minutes, coarse islands of the gamma (martensite) phase are formed to reduce the ductility of the resulting product. Preferably, the soaking is performed at a temperature between 730° and 780° C. for a period of 60 to 120 seconds.

If the above requirements for the composition and process conditions are met, the desired martensite phase is obtained by cooling the strip at a rate higher than 3° C./sec. The faster the cooling rate, the more the martensite phase that is produced, and hence the higher the strength that is achieved. But if the cooling is too rapid, a large amount of martensite is formed on the grain boundaries, which becomes the stress concentration sources in the plastic deformation and produces a product of low ductility. A good balance between the strength and ductility is obtained in a certain range of cooling rate which is from 10° to 50° C./sec for the purpose of this invention.

Herein, the cooling rate is defined as the average cooling rate down to 300° C. In this invention, overaging treatment is very disadvantageous and should be avoided.

This invention is now described in greater detail by reference to the following example which is given here for illustrative purposes only and is by no means intended to limit the scope of the invention.

EXAMPLE

Steel slabs having the chemical compositions indicated in Table 1 were hot rolled at a finishing temperature of 880° C. and coiled at a temperature of 580° to 650° C. into a sheet thickness of 3.0 mm. The strips were pickled and cold rolled to a thickness of 0.8 mm. The cold rolled strips were annealed continuously under the conditions indicated in Table 1. Table 1 shows the mechanical properties of the steel sheets obtained. The sheets were checked for their corrosion resistance. The results are also shown in Table 1. The samples A to F according to this invention had a yield point between 23 and 26 kg/mm$^2$ which was as low as that of the conventional formable cold rolled steel sheet. They had a tensile strength between 40 and 55 kg/mm$^2$, exhibiting a yield ratio of less than 0.6. The control samples G, I and J whose composition was outside the scope specified by this invention had a tensile strength between 41 and 53 kg/mm$^2$. Since they had a high yield point, their yield ratio was high. The control sample H which was also outside the scope of this invention even did not have a tensile strength of 40 kg/mm$^2$. Because of the high Si content, many pinholes developed in the sample I after checking its corrosion resistance.

As discussed in the foregoing, this invention provides a high-strength cold rolled steel sheet which has low yield point and yield ratio and hence is easily formable. Therefore, it can be used in inside and outside panels of automobiles. A high-strength hot rolled steel sheet of high press-formability can be produced from a hot rolled steel sheet by subjecting it to the continuous annealing as described herein so long as it has the composition specified herein. In another embodiment, a surface-treated steel sheet such as a high-strength zinc plated steel sheet may be produced from the hot strip or cold strip of this invention by a continuous hot zinc dipping apparatus.

TABLE 1

| sample No. | chemical composition (wt. %) C | Si | Mn | P | S | sol. Al | N | B | B-0.7 × N |
|---|---|---|---|---|---|---|---|---|---|
| our invention | | | | | | | | | |
| A | 0.060 | 0.02 | 1.64 | 0.013 | 0.010 | 0.046 | 0.0030 | 0.0034 | 0.0013 |
| B | 0.057 | 0.02 | 1.58 | 0.011 | 0.012 | 0.035 | 0.0021 | 0.0018 | 0.0013 |
| C | 0.055 | 0.03 | 1.20 | 0.012 | 0.011 | 0.024 | 0.0042 | 0.0045 | 0.0016 |
| D | 0.081 | 0.02 | 1.43 | 0.012 | 0.013 | 0.060 | 0.0044 | 0.0047 | 0.0017 |
| E | 0.10 | 0.03 | 1.30 | 0.014 | 0.011 | 0.039 | 0.0035 | 0.0045 | 0.0023 |
| F | 0.11 | 0.02 | 1.63 | 0.012 | 0.010 | 0.019 | 0.0030 | 0.0037 | 0.0020 |
| controls | | | | | | | | | |
| G | 0.070 | 0.02 | 1.36 | 0.014 | 0.012 | 0.040 | 0.0032 | — | |
| H | 0.042 | 0.02 | 0.82 | 0.013 | 0.010 | 0.036 | 0.0037 | 0.0029 | 0.0003 |
| I | 0.060 | 0.46 | 1.33 | 0.012 | 0.012 | 0.032 | 0.0036 | 0.0040 | 0.0015 |
| J | 0.150 | 0.02 | 1.60 | 0.012 | 0.010 | 0.030 | 0.0024 | 0.0032 | 0.0015 |

| sample No. | hot rolling conditions: coiling temp. (%) (°C.) | continuous annealing conditions: soaking | cooling rate (°C./sec) | mechanical properties: yield point (kg/mm$^2$) | tensile strength (kg/mm$^2$) | elongation (%) | yield ratio | corrosion resistance | B/C |
|---|---|---|---|---|---|---|---|---|---|
| our invention | | | | | | | | | |
| A | 620 | 775° C. × 2 min | 20 | 23.5 | 43.2 | 40 | 0.54 | good | 0.057 |
| B | 580 | 775° C. × 2 min | 100 | 23.9 | 48.2 | 34 | 0.49 | " | 0.032 |
| C | 650 | 775° C. × | 1000 | 24.5 | 55.1 | 29 | 0.44 | " | 0.082 |

TABLE 1-continued

| | | | | | | | | | |
|---|---|---|---|---|---|---|---|---|---|
| | | 2 min | | | | | | | |
| D | 600 | 775° C. × 2 min | 30 | 24.1 | 46.4 | 36 | 0.52 | " | 0.058 |
| E | 600 | 775° C. × 2 min | 10 | 25.4 | 49.0 | 30 | 0.52 | " | 0.045 |
| F | 630 | 775° C. × 2 min | 8 | 26.2 | 52.3 | 30 | 0.50 | " | 0.034 |
| controls | | | | | | | | | |
| G | 610 | 775° C. × 2 min | 10 | 32.8 | 41.0 | 38 | 0.80 | " | — |
| H | 650 | 775° C. × 2 min | 10 | 24.7 | 33.9 | 42 | 0.73 | " | 0.069 |
| I | 620 | 785° C. × 2 min | 10 | 33.9 | 45.6 | 36 | 0.74 | poor (many pinholes developed) | 0.067 |
| J | 590 | 820° C. × 2 min | 10 | 38.2 | 53.2 | 33 | 0.72 | good | 0.021 |

What is claimed is:

1. A process for producing a press-formable, high-strength, dual phase structure cold rolled steel sheet having a tensile strength of 40–50 kg/mm$^2$ which comprises hot rolling, at a finishing temperature higher than the $Ar_3$ transformation point, a steel slab consisting of C: 0.02–0.20%, Si: less than 0.1%, Mn: 1.2–2.0%, acid-soluble Al: 0.005–0.100%, B: more than 0.0003% and less than 0.0050% in terms of B%−0.7×N% in solid solution on the condition that B/C is more than 0.03, N: less than 0.0060%, the balance being iron and incidental impurities; cooling the hot strip at a rate of 10° to 150° C./sec, coiling the strip at a temperature lower than 730° C., pickling and cold rolling the coil, soaking the cold rolled strip at an annealing temperature between the $Ac_1$ transformation point and 800° C., and cooling the strip at a rate of more than 3° C./sec.

2. The process as defined in claim 1 wherein the soaking time is in the range of from 20 seconds to 5 minutes.

3. The process as defined in claim 1 wherein the soaking temperature and time are between 730° and 780° C. and between 60 seconds and 120 seconds, respectively.

4. The process as defined in claim 1 wherein the cooling rate annealing is between 10° and 50° C./sec.

5. The process according to claim 2 wherein said steel slab consists of: C: 0.057%, Si: 0.02%, Mn: 1.58%, acid soluble Al: 0.035%, N: 0.0021%, B: 0.0018% and the balance being iron and incidental impurities.

* * * * *